US009972878B2

(12) United States Patent
Lindmark

(10) Patent No.: US 9,972,878 B2
(45) Date of Patent: May 15, 2018

(54) ADJUSTABLE CONSTANT IMPEDANCE PHASE SHIFTER

(71) Applicant: FILTRONIC WIRELESS AB, Taby (SE)

(72) Inventor: Bjorn Lindmark, Taby (SE)

(73) Assignee: Filtronic Wireless AB, Taby (SE)

( * ) Notice: Subject to any disclaimer, the term of this patent is extended or adjusted under 35 U.S.C. 154(b) by 73 days.

(21) Appl. No.: 15/301,634

(22) PCT Filed: Mar. 24, 2015

(86) PCT No.: PCT/EP2015/056257
§ 371 (c)(1),
(2) Date: Oct. 3, 2016

(87) PCT Pub. No.: WO2015/150168
PCT Pub. Date: Oct. 8, 2015

(65) Prior Publication Data

US 2017/0117601 A1 Apr. 27, 2017

(30) Foreign Application Priority Data

Apr. 4, 2014 (SE) ..... 1450416

(51) Int. Cl.
*H01P 1/18* (2006.01)
*H01P 5/04* (2006.01)

(52) U.S. Cl.
CPC ..... *H01P 1/184* (2013.01); *H01P 5/04* (2013.01)

(58) Field of Classification Search
CPC ..... H01P 1/18; H01P 1/184; H01P 5/04
USPC ..... 333/137
See application file for complete search history.

(56) References Cited

U.S. PATENT DOCUMENTS 3,139,597 A * 6/1964 Jordan ..... H01P 1/184 333/161
2002/0030560 A1* 3/2002 Kim ..... H01P 1/184 333/156

FOREIGN PATENT DOCUMENTS

| | | | |
|---|---|---|---|
| EP | 1 054 466 | A2 | 11/2000 |
| JP | 11298212 | | 10/1999 |
| JP | 2001237603 | A | 8/2001 |
| JP | 2002033603 | A | 1/2002 |

(Continued)

OTHER PUBLICATIONS

International Search Report and Written Opinion dated May 29, 2015 for International Patent Application No. PCT/EP2015/056257.

*Primary Examiner* — Stephen E Jones
*Assistant Examiner* — Scott S Outten
(74) *Attorney, Agent, or Firm* — Fox Rothschild LLP; Carol E. Thorstad-Forsyth

(57) ABSTRACT

An adjustable constant impedance phase shifter is provided. In the adjustable constant impedance phase shifter a conductive circuit path is arranged between a conductive sheet and a parallel plane that is parallel to the conductive sheet; an edge of a dielectric plate and an edge of a conductive plate are adjoined such that the dielectric plate and the conductive plate form a slide member; and the slide member is movably arranged along a slide path between the circuit element and the conductive sheet so that any point of the conducting circuit path is consistently enclosed between the slide member and the parallel plane, and so that the relative permittivity of a medium adjacent to a point on the conductive circuit path is simultaneously changed as the slide member is moved.

13 Claims, 8 Drawing Sheets

(56) References Cited

FOREIGN PATENT DOCUMENTS

| | | | |
|---|---|---|---|
| JP | 2004023545 | A | 1/2004 |
| JP | 2010135893 | A | 6/2010 |

* cited by examiner

ADJUSTABLE CONSTANT IMPEDANCE PHASE SHIFTER

CROSS REFERENCE TO RELATED APPLICATION

The present application claims benefit of International Patent Application (PCT) No. PCT/EP2015/056257 filed on Mar. 24, 2015, which claims priority to Swedish Patent Application No. 1450416-1 filed on Apr. 4, 2014. Both of the above applications are incorporated herein by reference in their entirety.

FIELD OF THE INVENTION

The present invention generally relates to the field of adjustable constant impedance phase shifters.

BACKGROUND OF THE INVENTION

The velocity factor VF of electromagnetic waves in the transverse electric and magnetic, TEM, mode in ordinary transmission lines with the field immersed in a uniform dielectric of relative permittivity $\varepsilon_r$, relative to air, is $VF=1/\sqrt{\varepsilon_r}$.

Therefore, the relative phase between the input and output of a fixed length of transmission line may be varied by changing either the effective relative permittivity of the surrounding material, or the amount of the line surrounded by a dielectric relative the amount of the line surrounded by air.

A TEM transmission line is characterized by its characteristic impedance Z and its phase velocity v. These two parameters are given by the capacitance C and inductance L per unit length:

$$Z = \sqrt{\frac{L}{C}}$$

$$v = 1/\sqrt{L \cdot C}$$

The capacitance is proportional to the relative permittivity $\varepsilon_r$ of the transmission line and both the capacitance and inductance depend on the cross-section of the line. In particular, the inductance will increase with the separation between the conductors. Ordinary electrical cables cannot be used to carry currents in the radio frequency range or higher, which reverse direction millions to billions of times per second, because the energy tends to radiate off the cable as radio waves, causing power losses. Radio frequency currents also tend to reflect from discontinuities in the cable such as connectors and joints, and travel back down the cable toward the source. These reflections act as bottlenecks, preventing the signal power from reaching the destination. Transmission lines use specialized construction, and impedance matching, to carry electromagnetic signals with minimal reflections and power losses. The distinguishing feature of most transmission lines is that they have uniform cross sectional dimensions along their length, giving them a uniform impedance, called the characteristic impedance, to prevent reflections. Types of transmission line include parallel line (ladder line, twisted pair), coaxial cable, stripline, and microstrip. The higher the frequency of electromagnetic waves moving through a given cable or medium, the shorter the wavelength of the waves. Transmission lines become necessary when the length of the cable is longer than a significant fraction of the transmitted frequency's wavelength.

In the phase shifters using moving dielectrics as described in prior art, the impedance of the transmission line varies with the movement of the dielectric. This may be a problem.

U.S. Pat. No. 3,005,169, "Fye", 1961, discloses a microwave phase shifter aiming at overcome some of these problems. However, Fye e.g. does not disclose how a connection can be achieved between the disclosed "outer plates" and proper ground.

SUMMARY OF THE INVENTION

It would be advantageous to achieve a phase shifter overcoming, or at least alleviating, the above mentioned drawbacks. In particular it would be desirable to enable a phase shifter having a constant line impedance.

To better address one or more of these concerns, a phase shifter having the features defined in the independent claim is provided. Preferable embodiments are defined in the dependent claims.

Hence, according to an aspect an adjustable constant impedance phase shifter is provided. The adjustable constant impedance phase shifter comprises

- a circuit element comprising a conducting circuit path,
- a conductive sheet,
- a dielectric plate and a conductive plate, wherein:

- the conductive circuit path is arranged between the conductive sheet and a parallel plane parallel to the conductive sheet;

a spacing between the conductive plate and the conductive sheet is narrower than a spacing between said conductive plate and the circuit element;

- an edge of the dielectric plate and an edge of the conductive plate are adjoined such that the dielectric plate and the conductive plate form a slide member; and
- the slide member is movably arranged along a slide path between the circuit element and the conductive sheet so that any point of the conducting circuit path is consistently enclosed between the slide member and the parallel plane, and so that the relative permittivity of a medium adjacent to a point on the conductive circuit path is simultaneously changed as the slide member is moved.

When the relative permittivity of a medium adjacent to a point on the conductive circuit path is changed, a phase velocity v is changed due to a changed capacitance per unit length.

Hence, as the edge of the dielectric plate transgresses a point on the conductive path, so that the relative permittivity of an ambient or adjacent medium is reduced, the capacitance per unit length in said point is reduced, and the phase velocity in said point is increased.

However, the edge of the dielectric plate is adjoined with the edge of the conductive plate, such that if the said point leaves the immediate vicinity of the dielectric plate it enters the vicinity of the conductive plate, where the inductance per unit length is decreaseable through reduction of an effective distance between the circuit path and ground. A reduceable distance also enables the capacitance per unit length to be increased, but a proper choice of the thickness of the conductive plate may make the characteristic impedance constant when the point is adjacent to the dielectric plate and when it is adjacent to the conducting plate. Hence, the feature enables impedance matching such that the line impedance remains constant or close to constant.

The edge of the dielectric plate does not have to adhere to the edge of the conductive plate to enable the advantageous compensation.

In embodiments of the adjustable phase shifter, the circuit element and the slide member are arranged such that no part of a transverse, relative the slide path, portion of the circuit element may be transgressed by an intermediate boundary between the adjoined edges of the dielectric plate and the conductive plate.

In one embodiment of the adjustable phase shifter the dielectric plate and the conductive plate are coupled to each other to prevent relative movement between them. This facilitates operation of the phase shifter. For instance, a single actuator may operate both of the plates simultaneously.

In one embodiment of the adjustable phase shifter, the dielectric plate and the first conductive plate are engageably coupled to each other.

This reduces the need for additional fasteners, which may otherwise have an adverse impact, e.g. on the impedance matching or on mechanical design aspects influencing e.g. size or weight.

An embodiment of the of the adjustable phase shifter comprises a further conductive sheet, a further dielectric plate and a further conductive plate, wherein:

said further plates form a further slide member;

the slide member and the further slide member are symmetrically arranged in a fixed relationship on opposite sides of the circuit element; and the slide members are arranged between the conductive sheet and the further conductive sheet. The further slide member may have a configuration identical to the slide member described above so as to achieve optimal symmetry.

The two dielectric plates may form two wall portions of a single dielectric sleeve element. Likewise, the two conductive plates may form two wall portions of a single conductive sleeve element.

This embodiment enables the conductive circuit path to be effectively enclosed by the velocity-changing and impedance-compensating slide members.

The conductive plate may be arranged to operate as ground.

One embodiment of the phase shifter comprises a housing. The circuit element may be arranged in a fixed relationship to the housing.

This advantageously reduces the need for e.g. sliding contacts and flexible conductive bands, which may otherwise increase friction and introduce undesired electrical resistance.

At least one conductive sheet may form part of the housing.

This advantageously enables e.g. reduced size and assembly complexity.

Embodiments may further comprise an input connector and an output connector, said connectors being galvanically connected via the circuit element. This advantageously reduces the need for capactitive couplings between the input connector and the output connector.

Connectors fixed in relationship to the housing further advantageously facilitates system integration, as receiving connectors in the systems may not have to be movable on account of the phase shifter design.

In one embodiment the circuit element extends in a branching manner between the input connector and multiple output connectors.

This embodiment solves the problem of how to enable synchronized and robust progressive phase delay so as to enable an improved RET antenna array.

One embodiment comprises multiple circuit elements, each circuit element extending between an input connector and an output connector.

This embodiment solves the problem of how to enable synchronized and robust progressive phase delay so as to enable an improved RET antenna array.

In one embodiment the slide member is movable in a linear manner.

In one embodiment the slide member is movable in a rotational manner.

In embodiments, the phase shifter further comprises a spring arranged to separate the conductive plates.

In embodiments, the conductive plate is capacitively coupled to ground.

It is noted that embodiments of the invention relates to all possible combinations of features recited in the claims.

BRIEF DESCRIPTION OF THE DRAWINGS

This and other aspects will now be described in more detail in the following illustrative and non-limiting detailed description of embodiments, with reference to the appended drawings.

All the figures are schematic, not necessarily to scale, and generally only show parts which are necessary in order to elucidate the embodiments, wherein other parts may be omitted. Like reference numerals refer to like elements throughout the description.

DETAILED DESCRIPTION OF EMBODIMENTS

Figure 1A:
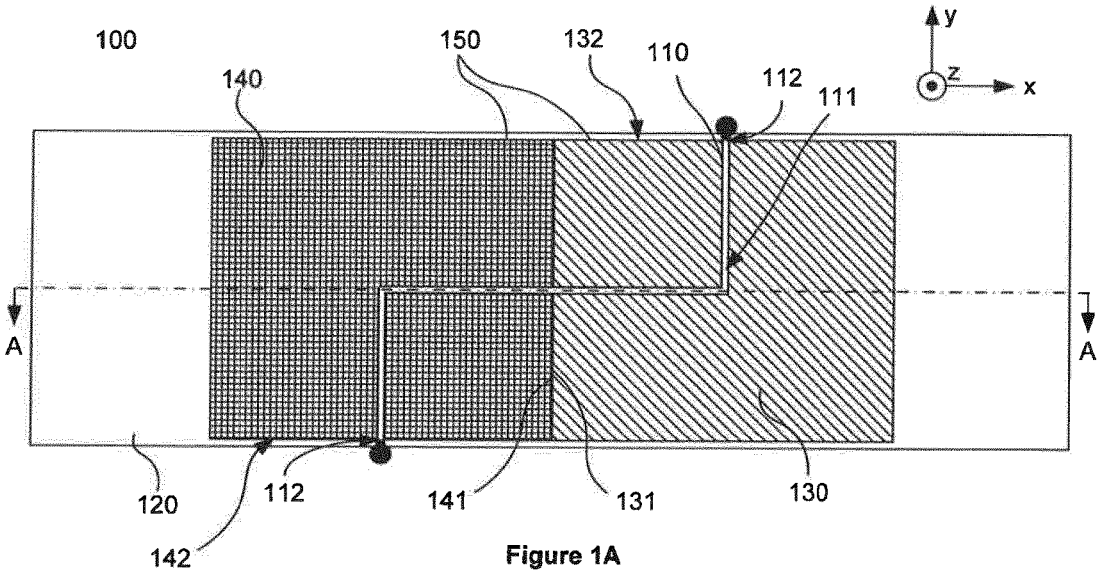
FIG. 1A shows a top view according to embodiments.

In the present specification, the term dielectric denotes a material or medium having a relative permittivity $\varepsilon_{r,\ d}$ significantly different from the relative permittivity $\varepsilon_{r,ground}$ in a space between two conductive media of a transmission line. The space may hold vacuum, e.g. may be evacuated, or may hold a gaseous medium, such as air. The velocity of TEM propagation along a part of the transmission line is a function of the $\varepsilon_r$ of the adjacent material or medium.

An adjustable constant impedance phase shifter according to an embodiment will be described with reference to FIG. 1. In essence, the phase shifter functions as a transmission line, comprising two conductive members 110, 120 arranged such that a voltage can be applied between them. The conductive member 110 is referred to as a circuit element 110. The second conductive member is referred to as a conductive sheet 120.

In order to enable adjustable constant impedance phase shifting properties, the phase shifter comprises a dielectric member 130. The dielectric member may be shaped as a plate, e.g. a body having two relatively wide substantially flat face surface portions between narrower edge surface extending between one face surface portion to the other and covering the perimetry of the face surface portions. The phase shifter also comprises a third conductive member 140, which may be shaped as a conductive plate 140. The dielectric plate 130 and the conductive plate 140 are both movable along a slide path between the conductive sheet 120 and the circuit element 110. In this embodiment, the slide path is linear along an axis x. The conductive plate and the dielectric plate are shaped, and may be arranged along the slide path such that, from a view perpendicular to the slide path, and directly facing one of the face surface portions of the conductive plate and one of the surface portions of the dielectric plate, an edge of the conductive plate and an edge of the dielectric plate appear to coincide, as illustrated in FIG. 1A.

Figure 1B:
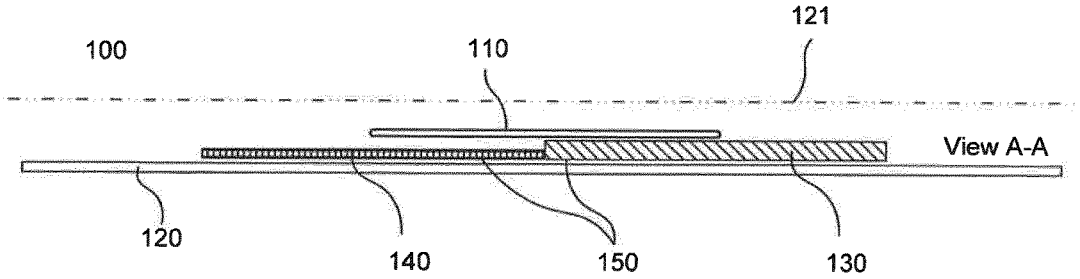
FIGS. 1B and 1C show exemplary alternative cross section side views of the embodiments in FIG. 1.

FIG. 1B is an exemplary side view cross section View A-A of a FIG. 1A.

FIG. 1B illustrates how the edges of the two plates may be adjoined in close connection.

Figure 1C:
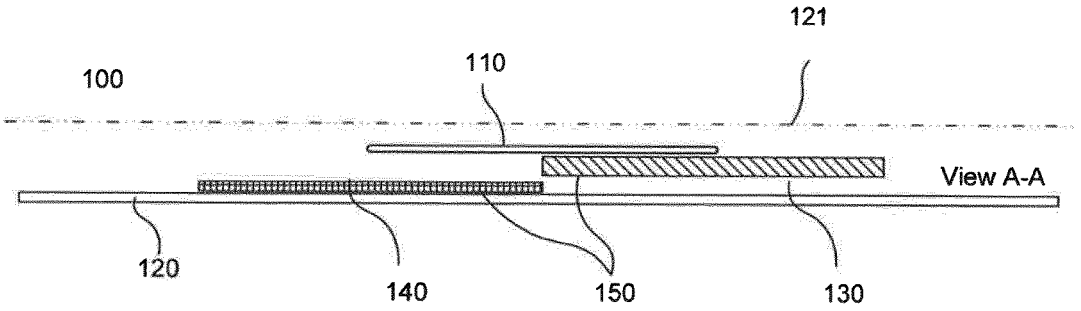

FIG. 1C is another exemplary side view cross section View A-A of FIG. 1A. For the purpose of the patent application, and as illustrated in FIG. 1C, the edges may also be adjoined to each other in the x-y dimension, while slightly displaced in relation to each other along the z-axis.

The plates 130, 140 are each shaped and arranged together such that as they move along the slide path, an outer edge point 112 on the circuit element 110 is steadily positioned over (in the z-direction) an outer edge 142 of the conductive plate 140. Analogously, an outer edge point 112 on the circuit element 110 is steadily positioned on an outer edge 132 of the dielectric plate 130. The plates 130, 140 form a slide member 150.

Figure 3:
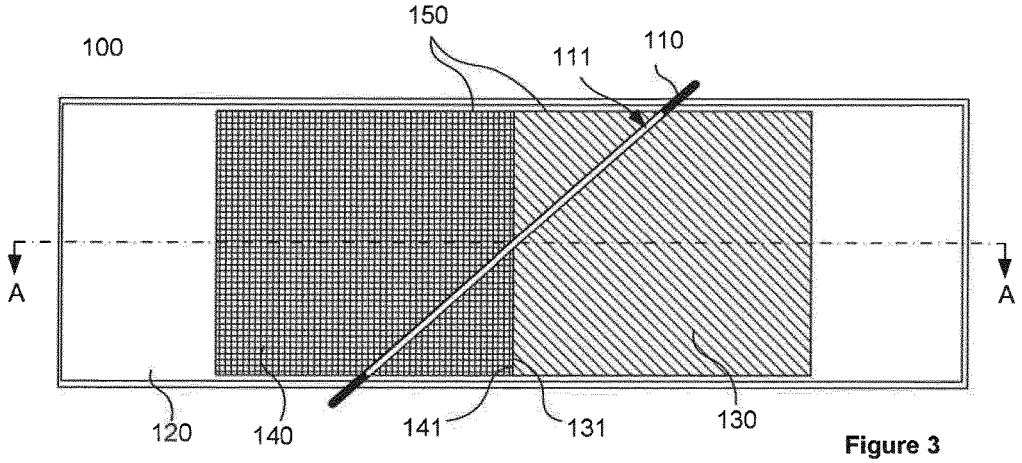
FIG. 3 show further exemplary embodiments.

The adjoined plate edges 131 and 141 form an intermediate boundary of the slide member 150. The intermediate boundary intersects the slide member 150 in an angle relative the slide path. The angle may be a right angle, as illustrated in FIG. 1A, or oblique, as illustrated in FIG. 3. As the slide member 150 moves along the slide path, the intermediate boundary consistently extends across a conducting circuit path 111 path defined as a line or curve between the above mentioned outer edge points 112, such that the conductive path is consistently enclosed between the surface of the slide member and an imaginary parallel plane 121 as illustrated in FIGS. 1A-C.

Though the intermediate boundary is illustrated as perpendicular to the slide path, it is entirely possible to implement a slide member with an intermediate boundary comprising a portion that is not perpendicular to the slide path.

In FIG. 1, the slide member is depicted in a position which for the purpose of this patent application is referred to as "neutral". In relation to the neutral position, the slide member may reach a maximum absolute displacement +/−Δ. The slide member 150 may preferably not move to a position where the relative permittivity of a medium adjacent to an outer edge point on the conductive circuit path 111 is simultaneously changed as the slide member 150 is moved.

In other words, the intermediate boundary may preferably not transgress, or for practical purposes (in relation to an applied frequency) come in close range to, an outer edge point 112 of the conductive circuit path 111.

In yet other words, the dielectric plate 130 and the conductive plate 140 is movable between a respective first position and a respective second position relative a portion of the circuit element, and arranged such that when the dielectric plate 130 and the conductive plate 140 are in their respective first positions, no part of the conductive plate 140 is located between the portion of the circuit element 110 and the conductive sheet 120; only a portion of the dielectric plate 130 is located between the portion of the circuit element 110 and the conductive sheet 120. Further, when the dielectric plate 130 and the conductive plate 140 are in their respective second positions, a part of the conductive plate 140 is located between the portion of the circuit element 110 and the conductive sheet 120.

An adjustable constant impedance phase shifter according to an embodiment will be described with reference to FIGS. 2A and 2B.

This embodiment comprises a U-shaped circuit element 110 and a conducting circuit path 111. As opposed to embodiments described in relation to FIG. 1, the outer edge points of the conducting circuit path 111 of the embodiment described in relation to FIG. 2A are both arranged on the same side of the intermediate boundary. FIG. 2A discloses outer edge points on the dielectric plate side of the boundary, but in certain embodiments the outer edge points may instead be arranged on the conductive plate 140 side of the intermediate boundary.

Figure 2A:
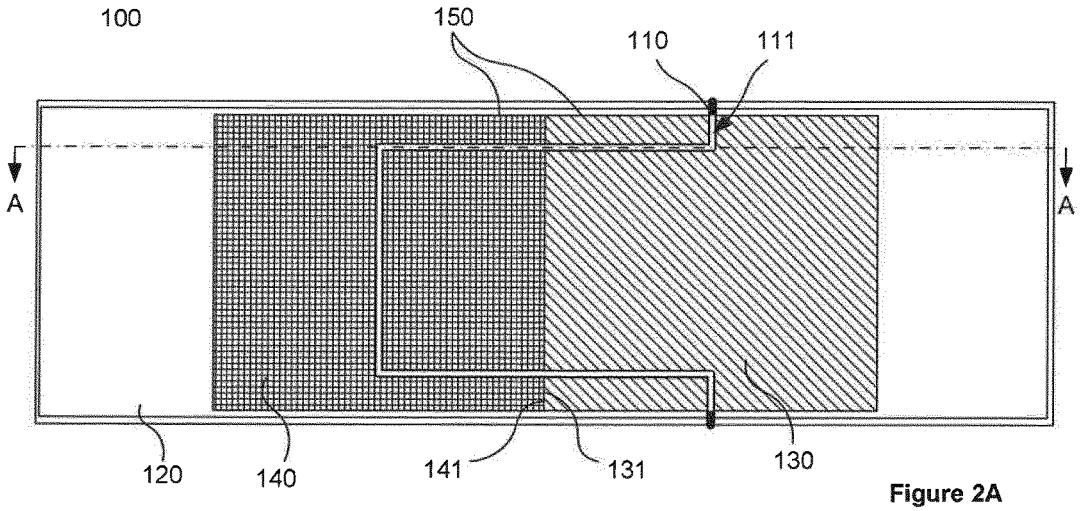
FIGS. 2*a* and 2B show an exemplary top view and cross section of embodiments.
Figure 2B:
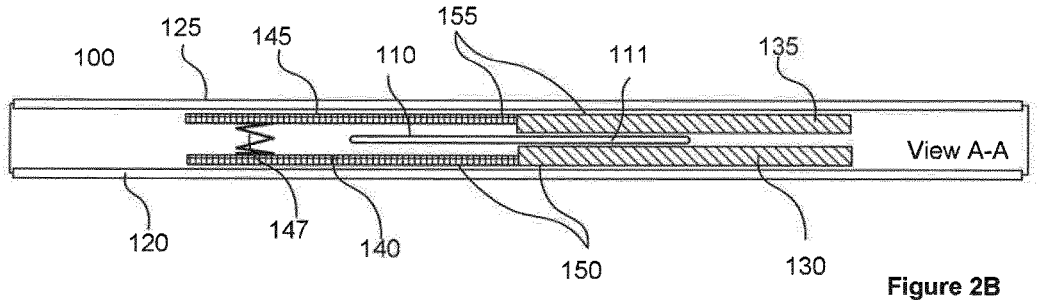

FIG. 2B discloses an embodiment wherein the circuit element 110 is embedded between a pair of slide members 150, 151 of similar construction.

The slide member pair is symmetrically arranged in a fixed relationship on opposite sides of the circuit element 110.

The slide members 150, 155 are arranged between the conductive sheet 120 and the further conductive sheet 125.

The circuit element 110 is at least partially embedded between conductive plates 140 and 145 leaving a spacing between the circuit element 110 and each conductive plate 140, 145.

Each slide member 150, 155 is movably arranged between the conductive sheets 120, 125 and may be displaced along a displacement axis x. The movably arranged parts may be coupled to each other, e.g. forming a stripline structure, so as to prevent relative movement in relation to each other.

A phase shift is achieved by displacing the movably arranged parts by a distance along the displacement axis x such that the electrical length of an equivalent transmission line changes. As seen in 2A, the U-shaped circuit element 110 is further shaped in a bend to form a first and a second end extending transverse from each one of the legs of the circuit element 110, and at least partly protruding from in between the slide members 150, 155. Each circuit element 110 end may be terminated by a connector (not shown in FIG. 2A) that is not embedded within the slide members 150, 155.

FIG. 2B is a side view cross section of the embodiment as shown in FIG. 2A. In an implementation of this embodiment, the slide members 150, 155 form a stripline structure with a total height of 7 mm. The dielectric plates 130, 135 are 3 mm thick and the conductive plates 140, 145 are 1.55 mm thick. The length of the stripline structure in the displacement dimension is 110 mm and is arranged within a housing to allow for a displacement of ±Δ of the slide members from a neutral position, where Δ=15 mm.

The edge of the dielectric plate is adjoined with the edge of the conductive plate, such that if the said point leaves the immediate vicinity of the dielectric plate it enters the vicinity of the conductive plate, where the inductance per unit length is decreasable through reduction of an effective distance between the circuit path and ground. The reduced distance will also cause an increase in the capacitance per unit length, but a proper choice of the thickness of the conductive plate will make the characteristic impedance constant when the point is adjacent to the dielectric plate and when it is adjacent to the conducting plate.

In order to maintain an appropriate spacing between the conductive plates 140, 145, the phase shifter may comprise a spring 147 arranged to separate the conductive plates 140, 145, as illustrated in FIG. 2B.

The spacing between a conductive plate 140, 145 and a conductive sheet 120, 125 may be narrower than a spacing between the conductive plate 140, 145 and the circuit element 110.

Figure 4A:
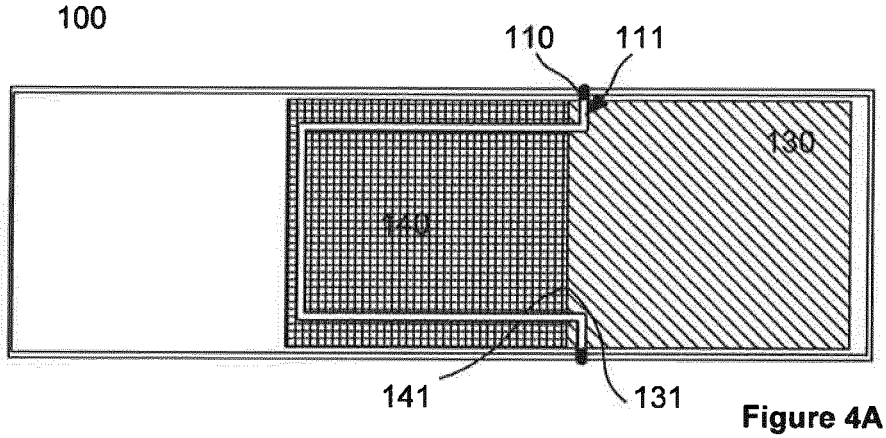
FIG. 4 illustrates two extreme displacement positions of components of embodiments.
Figure 4B:
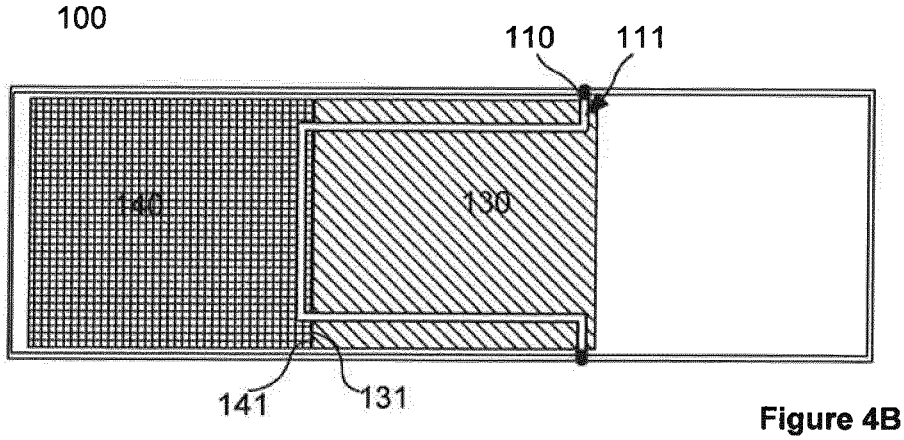

FIG. 4A illustrates the slide member 150 in a first extreme position along the displacement axis (x-axis), corresponding to +Δ. In this position the phase shifter 100 provides a minimum phase delay FIG. 4B shows the phase shifter in a second extreme position, corresponding to −Δ. In this position the phase shifter 100 provides a maximum phase shift.

The embodiment disclosed in FIG. 4 is designed such that the total possible displacement length 2Δ is shorter than the portion of the legs that extend in parallel along the displacement axis, and arranged such that no part of the transverse, relative the displacement axis, circuit element 110 may be transgressed, or be adjacent to the intermediate boundary between a dielectric plate 130, 135 and a conductive plate 140, 145.

The adjustable constant impedance phase shifter may be enclosed in a housing 160.

The circuit element 110 may be arranged in a fixed relationship to the housing 160. As illustrated e.g. in FIG. 2, the conductive sheets 120, 125 may form part of the housing 160.

The phase shifter 100 may comprise an input connector 162 and an output connector 164, said connectors being galvanically connected via the circuit element 110.

Branching Circuit Element

Figure 5A:
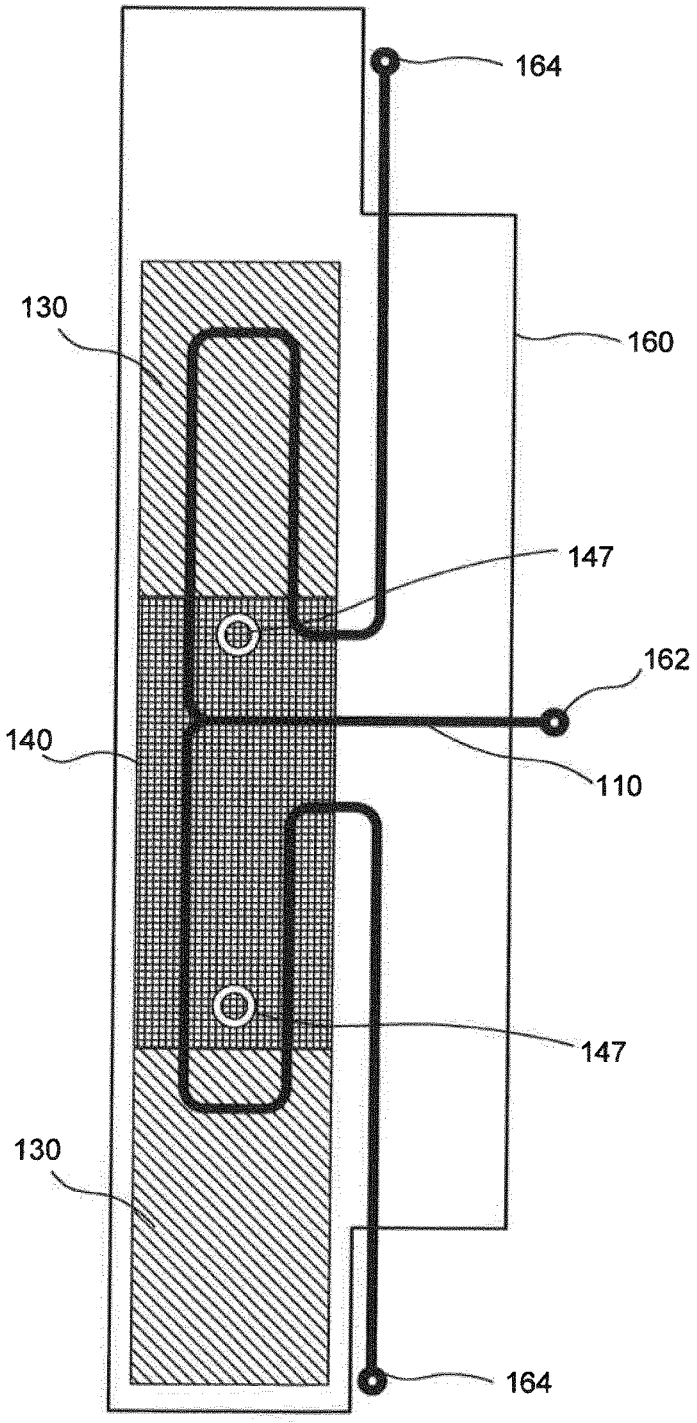
FIG. 5A-C illustrates a further embodiment.
Figure 5B:
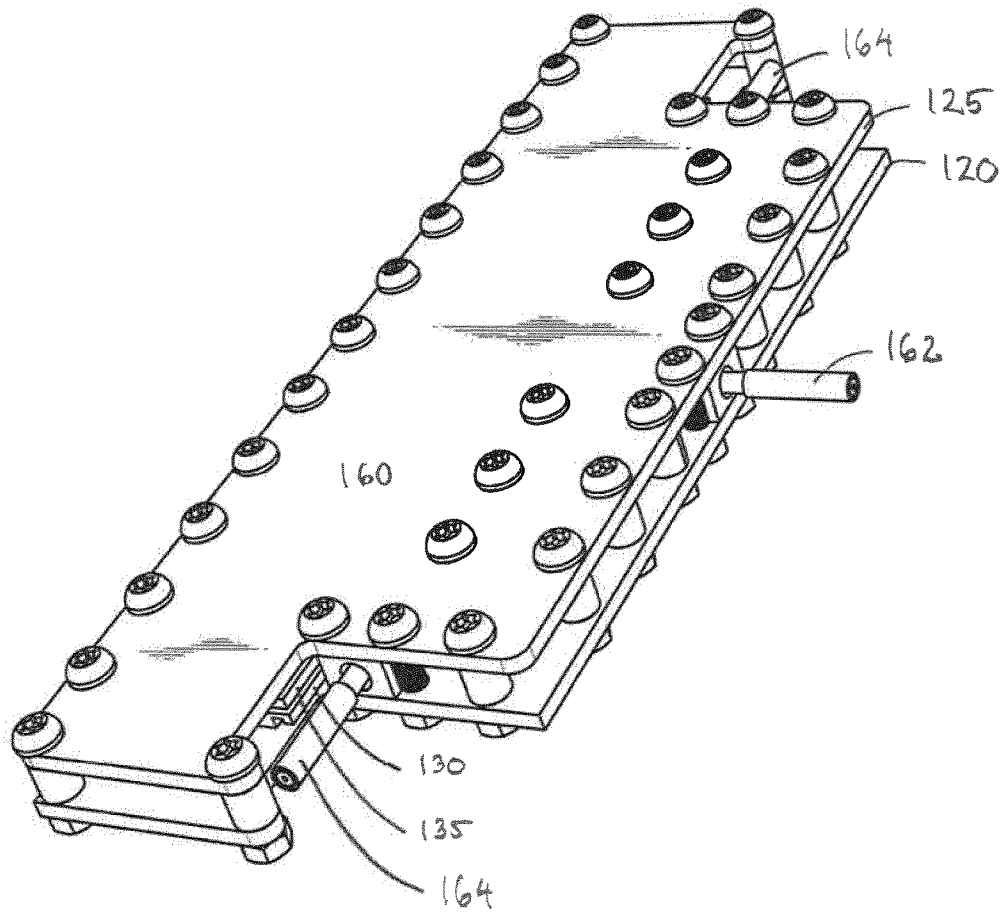

An embodiment of the phase shifter 100 will now be described in relation to FIG. 5. In this embodiment, the circuit element 110 extends in a branching manner between an input connector 162 and multiple output connectors 164.

This embodiment may be similarily configured as the embodiment described with reference to FIG. 2, but comprises two U-shaped portions.

As opposed to the embodiment described in relation to FIG. 2, the bends on the legs of the respective U-shape form a first end and two second ends extending vertically, in the y-dimension, in the same direction, rather than, as is the case in the other embodiments, in opposite directions. While there is one pair of movable dielectric plates 130 for each U-shaped circuit element portion, one conductive plate 140 is arranged to operate as moving ground for both U-shaped portions.

Figure 5C:
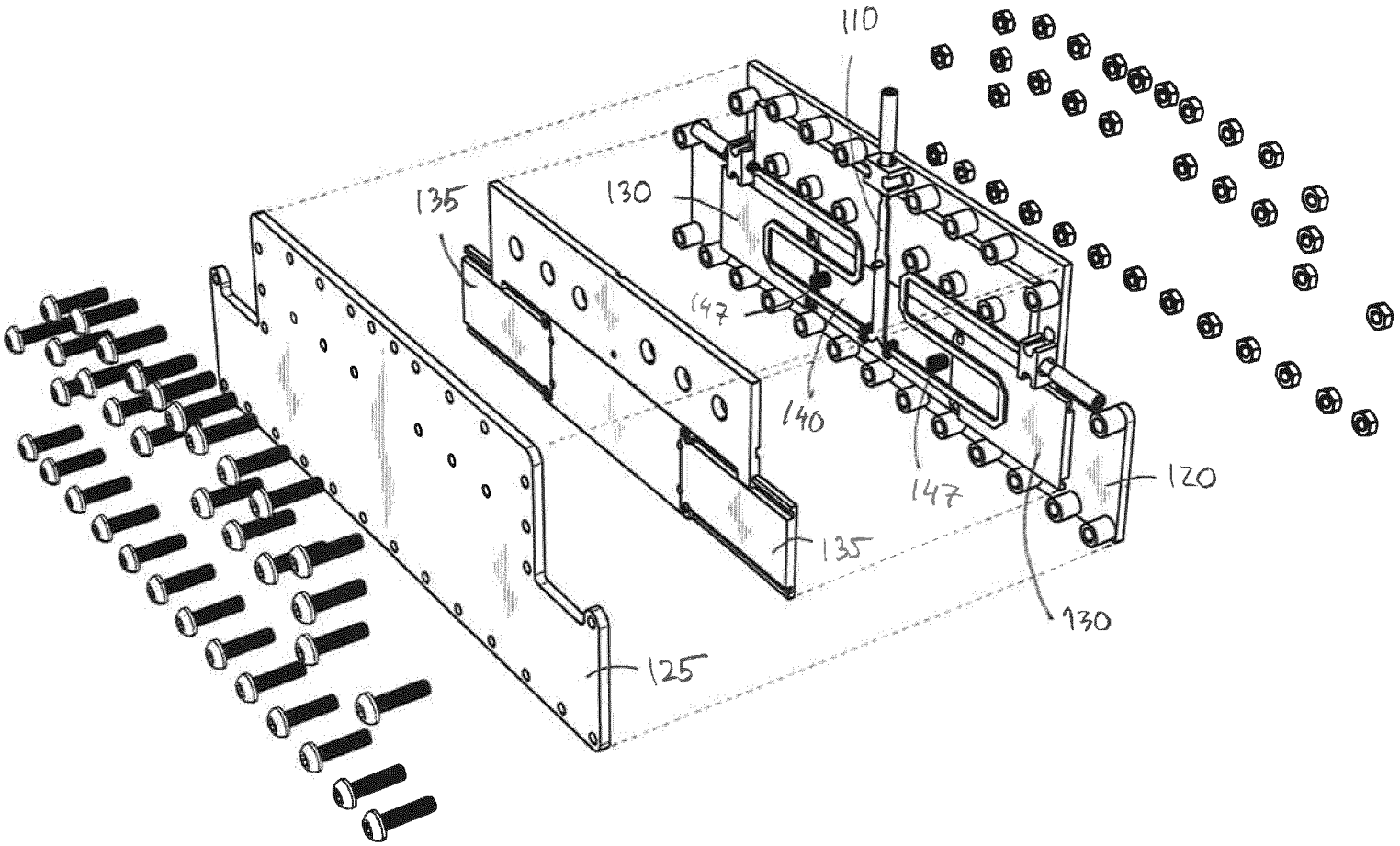

As illustrated in FIG. 5C, each movable dielectric plate 130, 135 is engageably coupled to a moving conductive plate 140, 145 arranged to operate as moving ground. Further, FIG. 5C shows two springs 147 comprised in the embodiment of the phase shifter 100. Each spring 147 serves to separate the two conductive plates 140, 145 from each other and from the circuit element 110, such that each conductive plate 140, 145 is closer to the grounded housing 160 than to the circuit element 110. Each conductive plate 140, 145 may hence be capacitively coupled to the grounded housing 160 and arranged to operate as floating ground.

The portions of the circuit element 110 are arranged such that no part of the transverse, relative the displacement axis, portions of the circuit element 110 may be transgressed, be in between, or be adjacent to the intermediate boundary between a conductive plate 140, 145 and a dielectric plate 130, 135.

This embodiment provides a linear phase shifter for 1700-2700 MHz providing two different phase shifts.

Figure 6A:
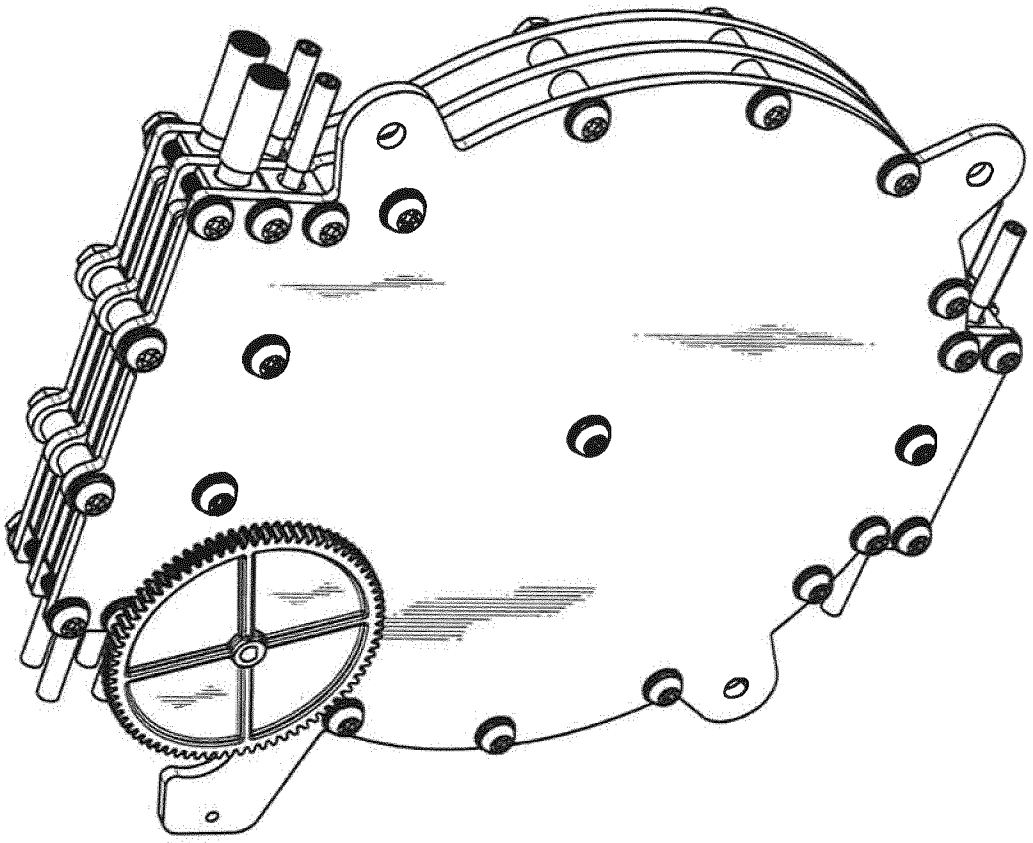
FIGS. 6A and B illustrate a further embodiment.

A phase shifter 100 according to another embodiment will be described with reference to FIGS. 6A and 6B This embodiment provides a rotatable phase shifter for 618-960 MHz providing four different phase shifts from four output connectors 164 and further an output connector 163 providing minimum phase shift, i.e. in all five "phase shifts", where one phase shift is at a minimum, as no part of the circuit element between output connector 163 and input connector 16 may be adjacent to a dielectric medium.

The phase shifter according to this embodiment may be configured in analogy with embodiments described with reference to the previous figures and may be advantageously described in relation to a cylindrical coordinate system defined by an angular displacement dimension α, a radial dimension r and a depth dimension z, rather than the coordinate system with dimensions x, y, z, used to describe the previous embodiments.

Figure 6B:
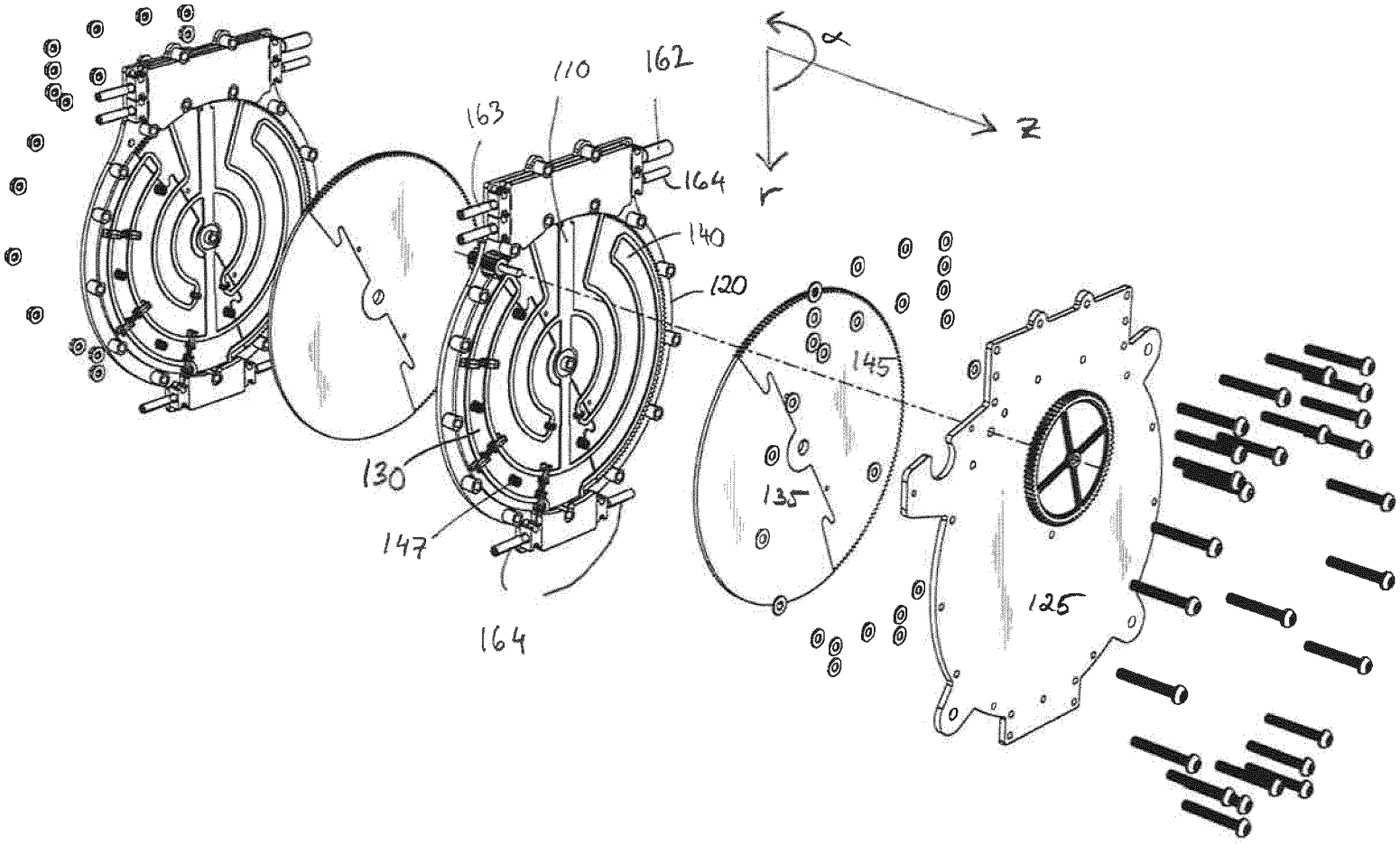

As illustrated by FIG. 6B, this embodiment comprises four U-shaped portions of the circuit element 110. In relation to this and other embodiments comprising rotationally moveable plates, the term "U-shaped portion of a circuit element" should be taken to mean two concentrical circular arcs of the same central angle in the α-dimension, joined in one end by a straight portion, which constitutes the "bottom" of the U-shape, and which extends in the r-dimension.

An edge of the dielectric plate 130, 135 and an edge of the conductive plate 140, 145 are adjoined such that the dielectric plate 130, 135 and the conductive plate 140, 145 form a slide member 150, 155; and the slide member 150, 155 is movably arranged along a slide path between the circuit element 110 and the conductive sheet 120, 125 so that any point of a conducting circuit path 111 is consistently enclosed between the slide member 150, 155 and a parallel plane parallel to the conductive sheet 120, and so that the relative permittivity of a medium adjacent to a point on the conductive circuit path 111 is simultaneously changed as the slide member 150, 155 is moved.

The plates 130, 140 are each shaped and arranged together such that as they move along the slide path, an outer edge point on the circuit element 110 is steadily positioned over (in the z-direction) an outer edge of the conductive plate 140. Analogously, an outer edge point on the circuit element 110 is steadily positioned on an outer edge of the dielectric plate 130. The plates 130, 140 form a slide member 150.

The adjoined plate edges 131 and 141 form a intermediate boundary of the slide member 150. The intermediate boundary intersects the slide member 150 in an angle relative the slide path. The angle may be a right angle. As the slide member 150 moves along the rotational slide path, the intermediate boundary moves across the conducting circuit path 111 defined as a line or curve between the above mentioned outer edge points, such that the conductive path 111 is consistently enclosed between the slide members 150, 155.

In this embodiment, each slide member 150, 155 is circular, and is rotatable in a slide path around a rotational symmetry axis of its perimetry.

One part of each U-shaped portion of the circuit element 110 is embedded between a pair of dielectric plates 130, 135. The other part of each U-shaped portion is at least partially embedded between a pair of conductive plates 140, 145 leaving an air-filled spacing between the circuit element 110 and each conductive plate 140, 145.

Each dielectric plate 130, 135 is movably arranged within the housing and may be displaced rotationally in a displacement angle α around the rotational symmetry axis. Each conductive plate 140, 145 is movably arranged within the housing 160 and may be displaced in the same displacement dimension α. The movably arranged parts may be coupled to each other, e.g. forming a stripline structure, so as to prevent relative movement between each other.

A phase shift is achieved by rotating the slide members 150, 155 by an angle α such that a phase shift between an input connector 162 and output connector 164 changes.

The moveable dielectric plates and movable ground plates are arranged within the housing to allow for a displacement of ±α of the movable plates from a neutral position. A maximum displacement A may be +/−50 degrees.

The phase shifter embodiment disclosed in FIG. 6 is designed such that the total possible displacement angle 2A is smaller than the circular angle of the concentrical legs of the U-shaped transmission lines and arranged such that no radially running parts of the circuit element 110 may be transgressed, be in between, or be adjacent to the intermediate boundary between a conductive plate 140, 145 and a dielectric plate 130, 135. As further illustrated in FIG. 6, multiple circuit elements 110 with respective associated slide members 150, 155 may be stacked in the z-dimension While e.g. Fye briefly mentions introduction of multiple transmission lines to provide synchronous multiple phase shifting, Fye does not disclose or even hint how such embodiments could be enabled.

Fye does not disclose how to enable a phase shifter combining increased adjustable constant impedance phase shifting and synchronous multiple phase shifting, or how to overcome problems introduced in such embodiments in terms of impedance matching in the discontinuity between dielectric and air.

In order to scan a beam in an elevation angle, so called Remote Electrical Tilt, RET, may be applied, e.g. in a base station antenna array. A signal may be fed to multiple antenna elements comprised in an antenna array, such that each antenna element receives the signal with a specific delay. Each antenna element receives the signal with a progressive phase delay between each element in the array. This phase delay is linearly proportional to the frequency to achieve a constant time delay between each element.

An antenna array may have equally strong radiation in several directions, i.e. multiple main beams. These unintended beams of radiation are known as grating lobes and may occur in uniformly spaced arrays, when the antenna element separation is too large.

In order to reduce the occurrence of severe grating lobes, it is desirable to be able to apply phase shifting to at least 4 antenna elements while steering the beam.

A common required scan for a base station antenna array usually involves a downtilt such that a radiation pattern has a null, a first or a second, towards the horizon.

For a vertically oriented antenna array with a constant linear excitation over a length L and a first null at the horizon, a downtilt angle DTA may be approximated as $DTA_{approx}=\lambda/L$.

In order to achieve a null at the horizon, a difference $2\Delta=\lambda$ in geometric delay may be applied between a top-most and a bottom-most antenna element in the antenna array.

Embodiments of the present invention solves the problem of how to accomplish a robust signal path between inner and outer parts of the phase shifter transmission lines. Embodiments of the present invention further solves the problem of how to accomplish synchronized and robust progressive phase delay so as to enable an improved RET antenna array.

The person skilled in the art realizes that the present invention by no means is limited to the embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. An adjustable constant impedance phase shifter, comprising:

a circuit element comprising a conducting circuit path;

a conductive sheet;

a dielectric plate and a conductive plate;

wherein:

the conductive circuit path is arranged between the conductive sheet and a parallel plane parallel to the conductive sheet;

a spacing between the conductive plate and the conductive sheet is narrower than a spacing between said conductive plate and the circuit element;

an edge of the dielectric plate and an edge of the conductive plate are adjoined such that the dielectric plate and the conductive plate form a slide member;

the slide member is movably arranged along a slide path between the circuit element and the conductive sheet so that any point of the conducting circuit path is consistently enclosed between the slide member and the parallel plane, and so that the relative permittivity of a medium adjacent to a point on the conductive circuit path is simultaneously changed as the slide member is moved; and the circuit element and the slide member are arranged such that no part of a transverse, relative the slide path, portion of the circuit element (110) may be transgressed by an intermediate boundary between the adjoined edges of the dielectric plate and the conductive plate.

2. The phase shifter according to claim 1, further comprising a housing.

3. The phase shifter according to claim 2, wherein the circuit element is arranged in a fixed relationship to the housing.

4. The phase shifter according to claim 2, wherein at least one conductive sheet forms part of the housing.

5. The phase shifter according to claim 1, comprising:

a further conductive sheet;

a further dielectric plate and a further conductive plate;

wherein:

said further plates form a further slide member;

the slide member and the further slide member are symmetrically arranged in a fixed relationship on opposite sides of the circuit element; and the slide members are arranged between the conductive sheet and the further conductive sheet.

6. The phase shifter according to claim 5, further comprising a spring arranged to separate the conductive plates.

7. The phase shifter according to claim 1, wherein the conductive plate is arranged to operate as ground.

8. The phase shifter according to claim 7, wherein the conductive plate is capactitively coupled to ground.

9. The phase shifter according to claim 1, further comprising an input connector and an output connector, said connectors being galvanically connected via the circuit element.

10. The phase shifter according to claim 1, wherein the circuit element extends in a branching manner between the input connector and the multiple output connectors.

11. The phase shifter according to claim 1, comprising multiple circuit elements, each circuit element extended between an input connector and an output connector.

12. The phase shifter according to claim 1, wherein the slide member is movable in a linear manner.

13. The phase shifter according to claim 1, wherein the slide member is movable in a rotational manner.

* * * * *